United States Patent [19]

Scott et al.

[11] 4,272,889

[45] Jun. 16, 1981

[54] PORTABLE SAW

[75] Inventors: Lewis A. Scott, Lake Oswego; Duane M. Gibson, Milwaukie, both of Oreg.

[73] Assignee: Omark Industries, Inc., Portland, Oreg.

[21] Appl. No.: 14,862

[22] Filed: Feb. 26, 1979

[51] Int. Cl.[3] ..... B27B 17/00

[52] U.S. Cl. ..... 30/371; 30/122; 30/382; 144/73

[58] Field of Search ..... 30/382, 377, 371, 122, 30/385, 387; 144/72, 73

[56] References Cited

U.S. PATENT DOCUMENTS

| | | | |
|---|---|---|---|
| 1,352,519 | 9/1920 | Laserson | 30/377 |
| 1,528,731 | 3/1925 | Barker | 30/377 X |
| 2,638,944 | 5/1953 | Woleslagle | 30/371 |
| 2,698,997 | 1/1955 | King | 30/382 X |
| 4,033,035 | 7/1977 | Trimmer | 30/122 |
| 4,143,460 | 3/1979 | Shean | 30/382 |
| 4,160,319 | 7/1979 | Caruso | 30/122 |
| 4,193,193 | 3/1980 | Holzworth | 30/382 |

FOREIGN PATENT DOCUMENTS

| | | | |
|---|---|---|---|
| 322333 | 12/1929 | United Kingdom | 144/73 |

*Primary Examiner*—Jimmy C. Peters

[57] ABSTRACT

The specification discloses a motor housing, with a handle of the circular saw type, and a cantilever saw bar carrying a saw chain is secured to the housing in a position extending downwardly from a guide foot of the housing. A retractable guard bar normally is held in a position holding a guard loop around the nose end of the saw bar, the guard bar being positioned at the rear of the saw bar. The guard bar is mounted slidably on the motor housing, and, when a latch is manually released, the guard loop may be pushed up along the saw during a boring (nose cutting) operation. In an alternate embodiment, a foot attachable to a foot of a circular saw motor carries a saw bar and a guard bar with a guard loop surrounding the nose end of the saw bar.

18 Claims, 10 Drawing Figures

FIG. 1
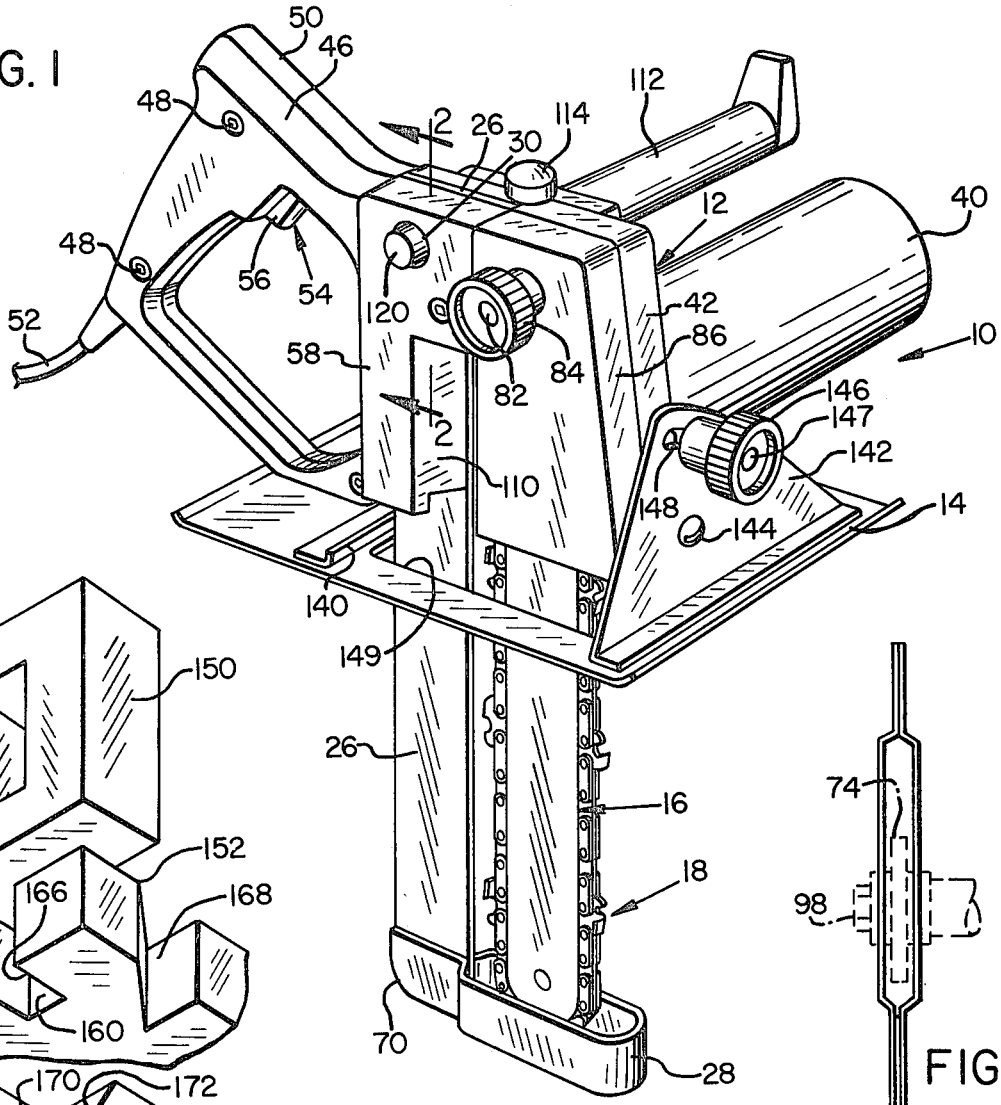
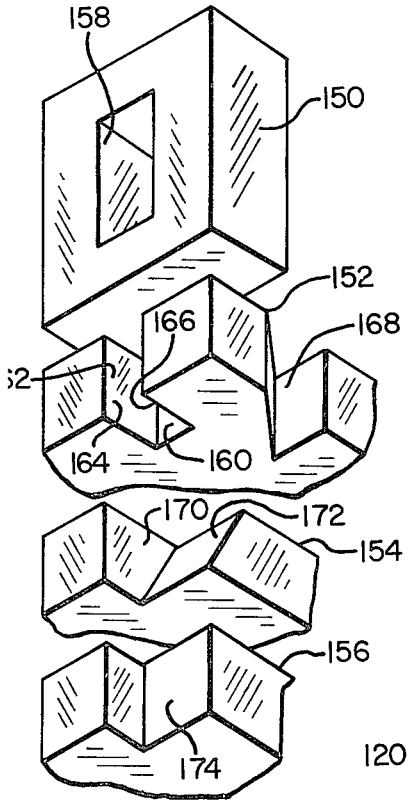
FIG. 7
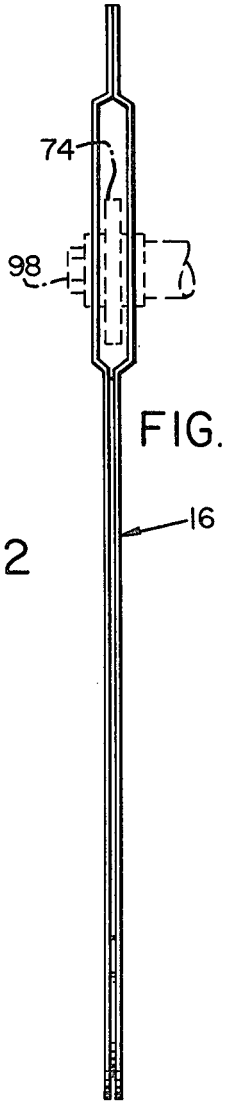
FIG. 6
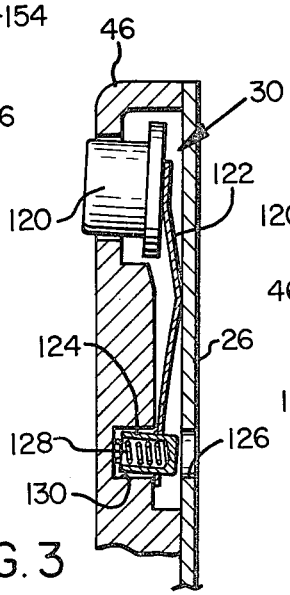
FIG. 3
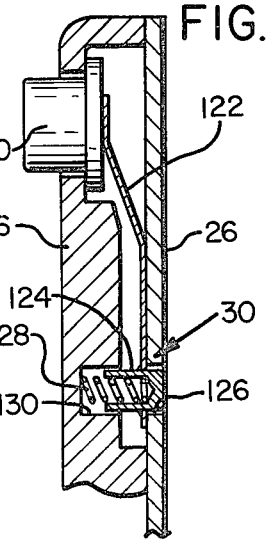
FIG. 2

10
12
14
16
18
20
26
28
30
32
42
44
46
48
50
52
54
56
58
60
62
64
66
68
70
74
80
82
86
88
92
94
96
98
100
102
104
106
108
110
114
116
120
122
124
140
142
144
146
147
148
149
190
5
5A
6

PORTABLE SAW

BACKGROUND OF THE INVENTION

Portable circular saws are very useful, but are limited in the depth they can saw. Chain saw bars and saw chains have been substituted for the circular blade in a circular saw as disclosed in U.S. Pat. No. 4,033,035, but it would be desirable to guard both the nose and the rear side of the chain. West German Pat. No. 804,863 shows a chain saw with a guard along one edge but with no guard over the nose portion of the saw bar. U.S. Pat. No. 1,861,162 discloses a chain saw with a rear guard and a nose guard but with the nose guard preventing boring operations. U.S. Pat. Nos. 2,998,997 and 2,291,470 show nose guards that prevent boring. U.S. Pat. No. 2,638,944 discloses a telescopic annular guard covering a saw bar entirely and permitting boring but normally preventing side cutting.

SUMMARY OF THE INVENTION

The invention provides a rear guard bar mounted on a motor housing and normally in a position in which a nose guard covers the nose of a saw bar mounted on the housing. The guard bar extends along the rear of the saw bar and is retractable to move the nose guard along the saw bar to expose the nose of the saw bar for boring.

DRAWINGS

In the drawings:

FIG. 1 is a perspective view of an improved portable saw forming one embodiment of the invention;

FIGS. 2 and 3 are enlarged, fragmentary, horizontal, sectional views taken along line 2—2 of FIG. 1;

FIG. 6 is a view taken along line 6—6 of FIG. 4;

FIG. 7 is a perspective view of a plurality of articles cut by the saw of FIG. 1;

Figures 4, 5, 5A:
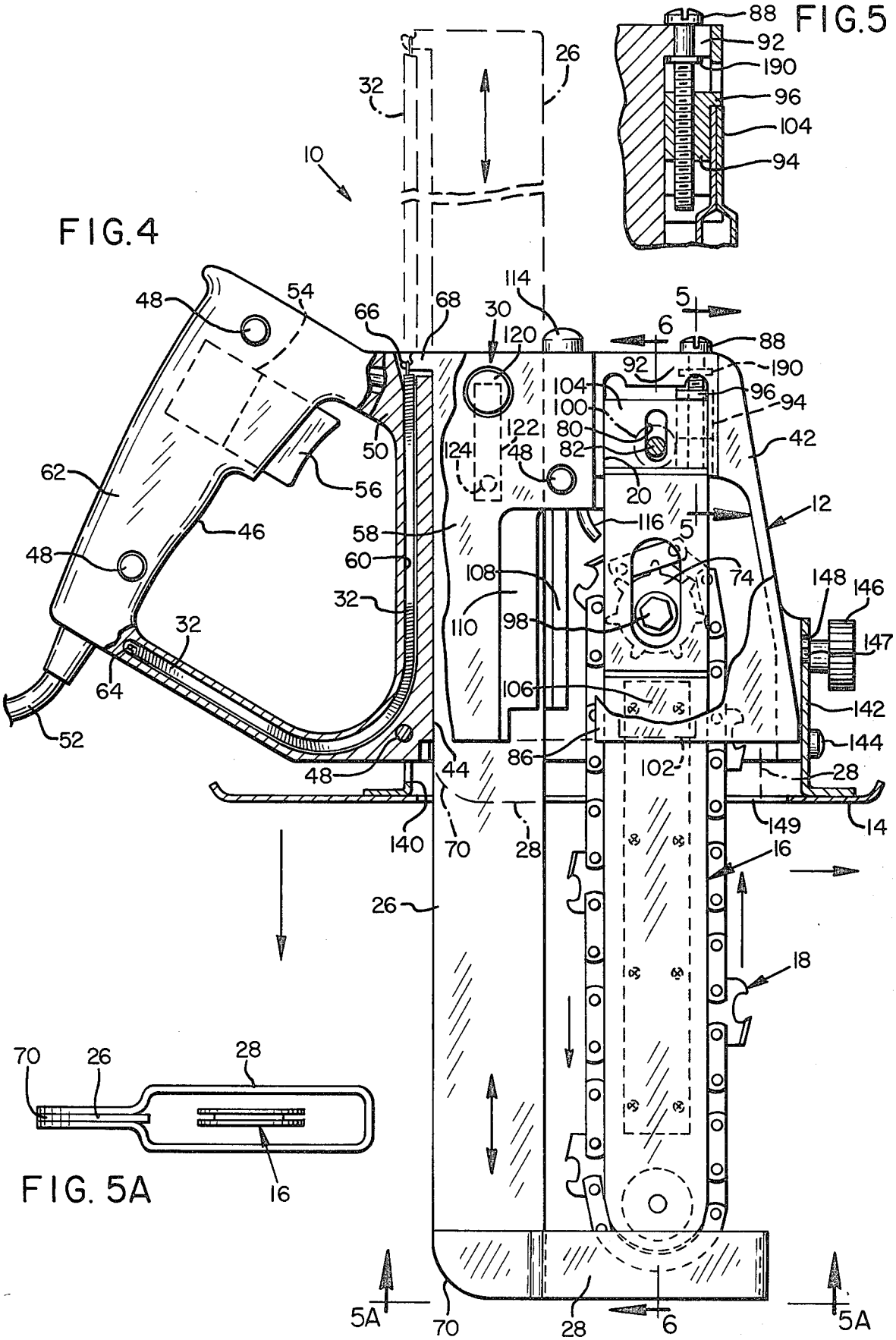
FIG. 4 is a vertical, sectional view of the saw of FIG. 1.
FIG. 5 is an enlarged, vertical, sectional view taken along line 5—5 of FIG. 4.
FIG. 5A is a bottom plan view taken along 5A—5A of FIG. 4.
Figures 8, 9:
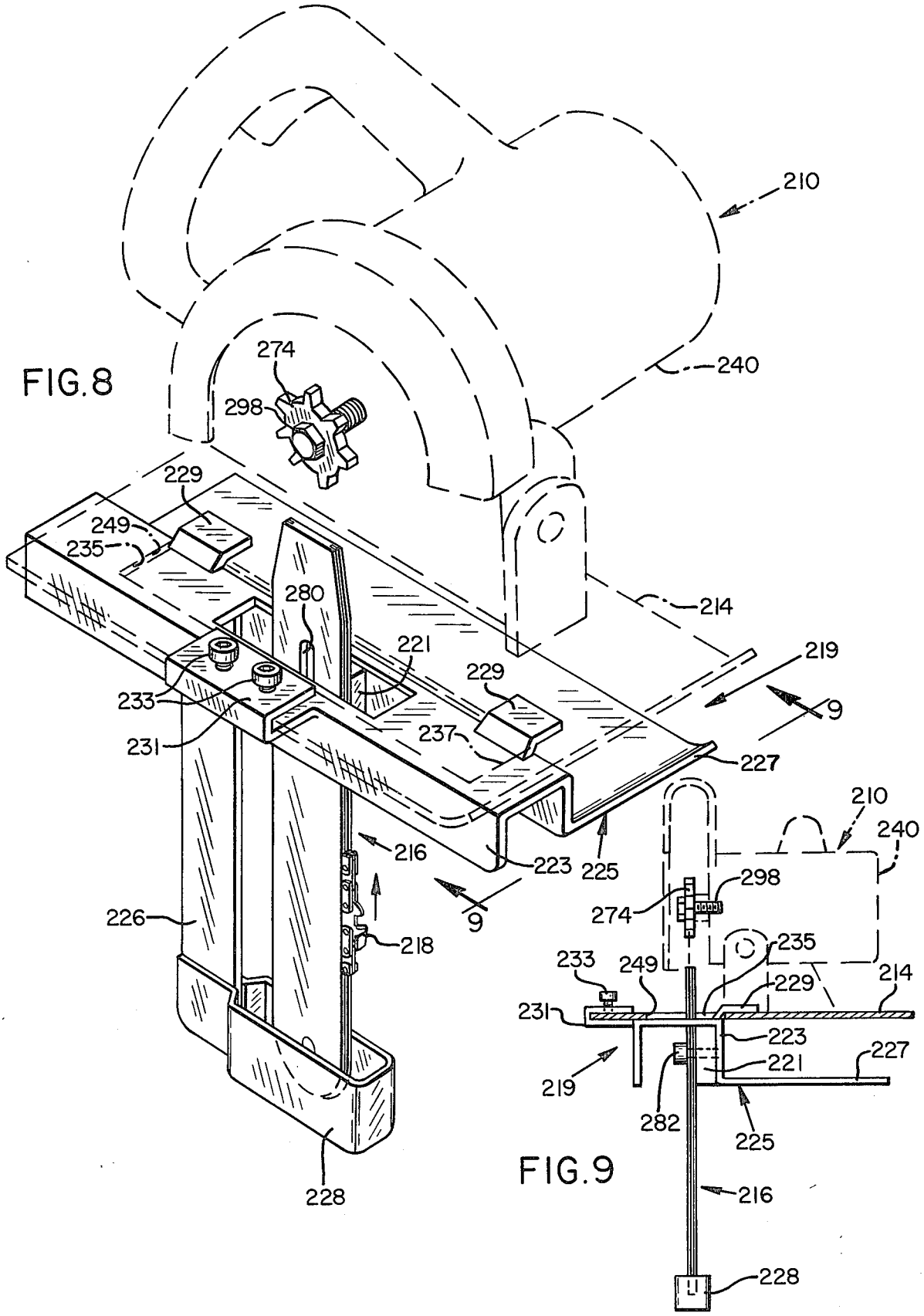
FIG. 8 is a perspective view of a chain saw attachment mounted on a circular saw prime mover and forming an alternate embodiment of the invention; and, FIG. 9 is a vertical, sectional view taken along line 9—9 of FIG. 8.

An improved portable saw 10 (FIGS. 1-6) forming a specific embodiment of the invention includes a saw housing 12 containing an electric motor and having an adjustable guide foot or shoe 14 adapted to rest on work to be sawed. A generally vertical saw bar 16 carrying and guiding a saw chain 18 is adjustable along a guideway 20 (FIG. 4) formed in the housing 12 and along a guide pin 82. A guard bar 26, which extends along the rear of the saw bar and the saw chain, carries a guard loop 28 loosely surrounding the saw bar and the saw chain. For straight cutting operation, the guard bar is latched in an extended or down position in which the guard loop covers only the nose portions of the saw bar and saw chain. For boring operation, a latch 30 is manually released to permit the guard bar and the guard loop to be retracted upwardly along the saw bar to expose the nose end portions of the saw bar and saw chain substantially the entire portions of the saw bar and chain below the foot 14. A long tension spring 32 urges the guard bar toward its extended position.

The housing 12 (FIGS. 1 and 4) includes a motor housing 40 and a head end casting 42 having the saw bar guideway 20 therein and also forming one side of a long, parallel guard bar guideway 44 extending substantially the entire height of the casting 42. A handle cover 46 is secured by screws 48 to a handle portion 50 of the casting 42 and forms therewith a hollow handle into which an electric power cord 52 extends to a conventional trigger switch 54 connected to the motor, the switch having a conventional trigger 56. The handle cover also includes a cover portion 58 having three sides of the guard bar guideway 44 therein. The handle cover also has a long, curved bore 60 extending from a handle portion 62 to the top thereof to loosely contain the spring 32. One end of the spring is hooked over a pin 64 and the other end of the spring is hooked over a hook 66 on a finger 68 of the guard bar 26. The handle is positioned as to normally hold the saw bar vertically, rather than normally horizontally as most chain saw bars are held, to adapt the saw for vertical cutting like a circular saw cuts.

The guard bar 26 (FIGS. 4 and 5) and the guard loop 28 have a rounded, rear, lower corner 70. The guard bar is rigid but is substantially thinner than the saw bar 16, which is thinner than the kerf formed by the saw chain in cutting. The centerline of the plane of the guard bar is centered relative to the centerline of the plane of the saw bar so that the guard bar has clearance in all kerfs formed by the saw chain. The guard loop 28 also is rigid, and is welded to the lower end of the guard bar at right angles thereto. The guard loop, as best shown in FIG. 5A, has substantial clearance on the sides, front and rear of the saw chain and extends substantially forwardly of the front or straight cutting course of the saw chain. As best shown in FIG. 4, the guard loop covers only the tip or nose portion of the saw. This, plus the cantilever form of the saw bar, give a very long forward or front cutting length, the cantilever form of the saw bar permitting the shoe 14 to be up quite close to sprocket 74 at the upper end of the path of the saw chain. The saw bar, the saw chain, and the sprocket are insertable and removable as a unit, and may be deemed a "cassette", which is disclosed and claimed in our copending application, Ser. No. 015,111, filed Feb. 26, 1979. It will be understood that the guard bar and loop can also be used with saws having conventional saw bars.

The saw bar 16 has a longitudinal slot 80 (FIG. 4) through which the pin or stud 82 from the casting 42 extends. A nut 84 (FIG. 1) screwed onto the stud 82 secures a cover 86 to the casting and clamps the saw bar tightly against the casting 42 to lock the saw bar in adjusted position on the casting with the saw chain 18 tight. An adjustment screw 88 (FIG. 4) has a collar 190 bearing against a flange 92 of the casting and is screwed into a nut 94 having a finger 96 engaging the end of the saw bar. When the screw 88 is screwed in a direction unscrewing itself out of the nut 94, the nut presses the saw bar downwardly in a chain tightening direction, the sprocket 74 being mounted on shaft 98 of the motor. The cover 86 has lugs 100 and 102 engaging upper portion 104 and intermediate portion 106 of the saw bar to clamp the saw bar against the casting 42.

The saw has a bevelled rib 108 and a sloping edge 110 of the cover 46 form a deflector for sawdust and chips from the sprocket area. A side handle 112 (FIG. 1) is hollow so as to serve as a reservoir for oil. A pump is controlled by a pushbotton 114 to pump oil flow from the revervoir to a nozzle tube 116 directed toward the portion of the saw chain 18 on the sprocket.

The latch 30 (FIGS. 1–3) includes a push button 120 adapted to press an angled lever 122 clockwise to move a pin 124 out of a latching hole 126 in the guard bar 26, against the action of a compression spring 128 in a bore 130. The latch is shown in its normal latching position in FIG. 2 in which the pin is in the hole 126 and is shown in its releasing position in FIG. 3. The push button is so located as to be pressed by the forefinger of the user when the saw is to be used for boring.

The foot 14 (FIG. 1) is mounted on brackets 140 and 142 pivoted on an aligned pair of screws 144 for angular adjustment about a longitudinal axis. A nut 146 on a stud 147 carried by the casting 42 serves to clamp the bracket 142 in adjusted position. An arcuate slot 148 in the bracket 142 is centered on the pin 144. The foot has a clearance opening 149. The clearance opening is large enough to permit the guard loop 28 to move therethrough, and, preferably, there is sufficient clearance in the cover and the frame to permit the loop to be retracted to a position in which the bottom of the loop is flush with the bottom of the foot.

FIG. 7 shows pieces 150, 152, 154 and 156 having cuts made by the saw 10. The piece 150 has a rectangular hole 158 cut by boring. A face 160 of a notch 162 is also cut by boring, faces 164 and 166 being cut by straight cutting as is a notch 168. A notch 170 with a bevelled face 172 is cut by straight cutting. A corner notch 174 is formed by straight cutting.

EMBODIMENT OF FIGS. 8 AND 9

A conventional circular power saw 210 having an adjustable foot 214 and a motor housing 240 is shown having a chain sawing attachment 219 clamped to the foot 214 and forming an alternate embodiment of the invention. A sprocket 274 driving a saw chain 218 on a conventional saw bar 216 is mounted on the shaft 298 of the motor. The saw bar has an adjustment permittd by a slot 280 and a screw 282 clamps the saw bar to a block 221 welded to one side of a channel portion 223 of a mounting member 225 having a foot 227 parallel to the foot 214. Tabs 229 project through opening 249 in the foot 214 and a U-shaped mounting bracket 231 fits over the outer edge of the foot 214. A set screw 233 threaded through the top plate of the bracket 231 locks the attachment to the saw. The tabs engage edges 235 and 237 of the opening 249 to precisely position the attachment.

A guard bar 226 is bolted to the channel portion in the plane of the saw bar 216. A narrow guard loop 228 is welded to the guard bar in a position covering the nose end of the saw bar. The guard bar guards the rear course and the loop guards the nose course of the saw chain. However, the guard bar is not retractible to permit boring.

What is claimed is:

1. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar having a thickness less than the thickness of said saw chain, a guard member mounted on one end of the guard bar, and mounting means mounting the guard bar on the housing in a position extending along a rear edge of the saw bar in the plane of the saw bar for longitudinal adjustment between an extended position in which the guard member covers the nose portion of the saw to prevent cutting by the saw chain in the region of the nose portion and a retracted position in which the guard member is withdrawn from the nose portion to allow cutting in the region of the nose portion while normally exposing the forward edge of the saw bar.

2. The power saw of claim 1 wherein the guard member extends loosely around the saw bar and the saw chain thereon.

3. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar having a thickness less than the thickness of said saw chain, a guard member mounted on one end of the guard bar in a position extending along the sides of the nose portion of the saw bar, and mounting means mounting the guard bar on the housing in a position extending along a rear edge of the saw bar and lying in the plane of the saw bar while normally exposing the forward edge of the saw bar.

4. The power saw of claim 3 wherein the guard member extends loosely completely around the saw bar and the saw chain thereon.

5. An attachment for a power saw having a motor housing with a guide plate secured to the housing and provided with a motor driven sprocket;

said attachment comprising:

a mounting member having releasable attaching means for securing the mounting member on the guide plate, a saw bar attachable to the mounting member and positioned to extend from the guide plate and having a nose portion remote from the guide plate, a saw chain entrained about said saw bar and said sprocket to be driven by said motor, a guard bar having one end secured to said mounting member and positioned to extend along the rear edge of the saw bar and in the plane of the saw bar, and a guard member on the other end of the guard bar and having portions extending along the sides of the nose portion of the saw bar.

6. The attachment according to claim 5, in which the guard member is a closed loop surrounding the nose portion of the saw bar.

7. The attachment according to claim 5 wherein said guard bar is retractable.

8. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar, a guard member mounted on one end of the guard bar, and mounting means mounting the guard bar on the housing in a position extending along a rear edge of the saw bar in the plane of the saw bar for longitudinal adjustment between an extended position in which the guard member covers the nose portion of the saw bar to prevent cutting by the saw chain in the region of the nose portion and a retracted position in which the guard member is withdrawn from the nose portion to allow cutting in the region of the nose portion while normally exposing the forward edge of the saw bar, including releasable latch means for holding the guard bar in its extended position.

9. The power saw of claim 8 wherein the guard member extends loosely around the saw bar and the saw chain thereon.

10. The power saw of claim 8 including spring means urging the guide bar toward its extended position.

11. The power saw of claim 8 wherein the guard member is in the form of a closed loop.

12. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar having a thickness less than the thickness of said saw chain, a guard member mounted on one end of the guard bar in a position extending along the sides of the nose portion of the saw bar, and mounting means mounting the guard bar on the housing in a position extending along a rear edge of the saw bar and lying in the plane of the saw bar while normally exposing the forward edge of the saw bar, wherein the mounting means mounts the guard bar for adjustment between an extended position in which the guard member extends around the nose portion of the saw bar to prevent cutting by the saw chain in the region of the nose portion and a retracted position in which the guard member is retracted behind the nose portion to allow cutting by the saw chain in the region of the nose portion.

13. The power saw of claim 12 including spring means urging the guide bar toward the extended position.

14. The power saw of claim 13 wherein the housing includes a handle and the handle has an elongated passage containing the spring means.

15. The power saw of claim 12 including releasable latch means for holding the guard bar in its extended position.

16. The power saw of claim 12 wherein the guard member is in the form of a closed loop.

17. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar, a guard member mounted on one end of the guard bar wherein the guard member extends loosely around the saw bar and the saw chain thereon and is in the form of a closed loop, and mounting means mounting the guard bar on the housing in a position extending along a rear edge of the saw bar in the plane of the saw bar for longitudinal adjustment between an extended position in which the guard member covers the nose portion of the saw bar to prevent cutting by the saw chain in the region of the nose portion and a retracted position in which the guard member is withdrawn from the nose portion to allow cutting in the region of the nose portion while normally exposing the forward edge of the saw bar.

18. In a power saw:

a motor having a housing, a guide plate attached to the housing, a saw bar secured to the housing in a position extending from the guide plate and having a nose portion remote from the guide plate, a sprocket driven by the motor, a saw chain entrained about the sprocket and the saw bar, a rigid guard bar having a thickness less than the thickness of said saw chain, a guard member mounted on one end of the guard bar in a position extending along the sides of the nose portion of the saw bar, wherein the guard member extends loosely completely around the saw bar and the saw chain thereon in the form of a closed loop, and mounting means mounting the guard bar on the housing in a position extending along a rear edge of the saw bar and lying in the plane of the saw bar while normally exposing the forward edge of the saw bar.

* * * * *